US007513221B2

(12) United States Patent
Akkala et al.

(10) Patent No.: US 7,513,221 B2
(45) Date of Patent: Apr. 7, 2009

(54) WATER HEATER WITH PRESSURIZED COMBUSTION

(75) Inventors: Marc W. Akkala, Cedarburg, WI (US); Ray O. Knoeppel, Hartland, WI (US)

(73) Assignee: AOS Holding Company, Wilmington, DE (US)

( * ) Notice: Subject to any disclaimer, the term of this patent is extended or adjusted under 35 U.S.C. 154(b) by 178 days.

(21) Appl. No.: 11/329,793

(22) Filed: Jan. 11, 2006

(65) Prior Publication Data

US 2006/0150925 A1 Jul. 13, 2006

Related U.S. Application Data

(63) Continuation of application No. 11/034,130, filed on Jan. 12, 2005, now Pat. No. 7,032,543.

(51) Int. Cl.
*F24H 9/20* (2006.01)

(52) U.S. Cl. ..... 122/14.22; 122/14.31

(58) Field of Classification Search ..... 122/13.01, 122/14.2, 14.22, 14.31
See application file for complete search history.

(56) References Cited

U.S. PATENT DOCUMENTS

| | | | |
|---|---|---|---|
| 1,354,295 | A | 9/1920 | Hamilton |
| 1,634,889 | A | 7/1927 | Shuell |
| 1,689,935 | A | 10/1928 | Shuell |
| 1,692,839 | A | 11/1928 | Humphrey |
| 1,737,202 | A | 11/1929 | Runnels |
| 1,961,231 | A | 6/1934 | Maier |
| 2,499,636 | A | 3/1950 | Finley |
| 2,617,390 | A | 11/1952 | Schueder et al. |
| 2,720,851 | A | 10/1955 | Strunsky |
| 3,006,408 | A | 10/1961 | Shepherd |
| 3,091,223 | A | 5/1963 | Vitale |

(Continued)

FOREIGN PATENT DOCUMENTS

| | | |
|---|---|---|
| FR | 1581702 | 9/1969 |

(Continued)

OTHER PUBLICATIONS

1953—MIT Fourth Symposium on Combustion.

(Continued)

*Primary Examiner*—Gregory A Wilson
(74) *Attorney, Agent, or Firm*—Michael Best & Friedrich LLP

(57) ABSTRACT

A water heater includes a sealed combustion chamber and one or more fans for raising pressure in the combustion chamber to increase efficiency of the water heater. The pressure permits a more restrictive baffle to be used in the flue compared to baffles used in atmospheric water heaters. The water heater may include a water temperature sensor that activates the fan without activating the burner if water temperature raises above a desired temperature. The water heater may also include pressure and vapor sensors to ensure the combustion chamber is properly sealed and there are no flammable vapors present prior to igniting the burner. The fans are relatively small and run off the same DC power that runs an electric gas valve. The fans may be, for example, 12 or 24 Volt fans with power inputs of about 10 Watts or less.

13 Claims, 4 Drawing Sheets

U.S. PATENT DOCUMENTS

| | | | | | |
|---|---|---|---|---|---|
| 3,110,302 | A | | 11/1963 | Buehl | |
| 3,124,108 | A | | 3/1964 | Wenczl | |
| 3,162,239 | A | | 12/1964 | Irons | |
| 3,163,159 | A | | 12/1964 | Buehl et al. | |
| 3,415,556 | A | | 12/1968 | Dryden | |
| 3,887,325 | A | * | 6/1975 | Finger et al. | 431/6 |
| 3,920,375 | A | | 11/1975 | Sanderson et al. | |
| 4,241,723 | A | | 12/1980 | Kitchen | |
| 4,373,472 | A | | 2/1983 | Kreis | |
| 4,541,410 | A | | 9/1985 | Jatana | |
| 4,651,714 | A | | 3/1987 | Granberg | |
| 4,672,919 | A | * | 6/1987 | Staats | 122/14.22 |
| 4,685,425 | A | | 8/1987 | Eising | |
| 4,766,883 | A | | 8/1988 | Cameron et al. | |
| 4,875,465 | A | | 10/1989 | Kramer | |
| 4,919,609 | A | | 4/1990 | Sarkisian et al. | |
| 4,924,816 | A | | 5/1990 | Moore, Jr. et al. | |
| 5,001,017 | A | | 3/1991 | Alhamad et al. | |
| 5,018,748 | A | | 5/1991 | Schalle | |
| 5,020,512 | A | | 6/1991 | Vago et al. | |
| 5,022,352 | A | | 6/1991 | Osborne et al. | |
| 5,097,907 | A | | 3/1992 | Alhamad et al. | |
| 5,146,911 | A | | 9/1992 | Adams | |
| 5,154,140 | A | | 10/1992 | Windon | |
| 5,197,456 | A | * | 3/1993 | Ryno | 122/18.31 |
| 5,317,992 | A | | 6/1994 | Joyce | |
| 5,355,841 | A | | 10/1994 | Moore, Jr. et al. | |
| 5,402,852 | A | | 4/1995 | Alhamad et al. | |
| 5,427,525 | A | | 6/1995 | Shukla et al. | |
| 5,429,186 | A | | 7/1995 | Kurz et al. | |
| 5,494,003 | A | | 2/1996 | Bartz et al. | |
| 5,501,472 | A | | 3/1996 | Brancher et al. | |
| 5,511,516 | A | | 4/1996 | Moore, Jr. et al. | |
| 5,533,495 | A | | 7/1996 | Moore, Jr. | |
| 5,687,678 | A | | 11/1997 | Suchomel et al. | |
| 5,697,330 | A | | 12/1997 | Yetman et al. | |
| 5,791,298 | A | | 8/1998 | Rodgers | |
| 5,794,707 | A | | 8/1998 | Alhamad | |
| 5,797,355 | A | | 8/1998 | Bourke et al. | |
| 5,826,569 | A | | 10/1998 | Voorhis | |
| 5,924,390 | A | | 7/1999 | Bock | |
| 5,937,796 | A | | 8/1999 | Sebastiani | |
| 5,941,200 | A | | 8/1999 | Boros et al. | |
| 5,941,231 | A | | 8/1999 | Garrett et al. | |
| 5,950,573 | A | | 9/1999 | Shellenberger et al. | |
| 6,003,477 | A | | 12/1999 | Valcic | |
| 6,109,216 | A | | 8/2000 | Reynolds et al. | |
| 6,216,643 | B1 | | 4/2001 | Reynolds et al. | |
| 6,230,665 | B1 | | 5/2001 | Reynolds et al. | |
| 6,244,223 | B1 | * | 6/2001 | Welk | 122/13.01 |
| 6,295,952 | B1 | | 10/2001 | Reynolds et al. | |
| 6,412,447 | B1 | | 7/2002 | Trant et al. | |
| 6,443,103 | B1 | | 9/2002 | Carbone et al. | |
| 6,446,581 | B1 | | 9/2002 | Carbone et al. | |
| 6,612,301 | B2 | | 9/2003 | Vago | |
| 6,745,724 | B2 | * | 6/2004 | Hughes et al. | 122/44.2 |
| 6,761,134 | B1 | * | 7/2004 | Trant | 122/14.1 |
| 6,854,428 | B1 | | 2/2005 | Hotton et al. | |
| 6,895,902 | B2 | * | 5/2005 | Kobayashi et al. | 122/13.01 |

FOREIGN PATENT DOCUMENTS

| | | |
|---|---|---|
| GB | 1557 | 5/1914 |
| JP | 58-72818 | 4/1983 |
| WO | WO 99/49268 | 9/1999 |

OTHER PUBLICATIONS (April) 1960; pp. 172-174, Coke and Gas, "Reports of the Industrial Gas Development Committee."

1963—Research Bulletin 97, Some New or Unusual Methods for Heating Water with Gas, J.C. Griffiths.

1988—Mor-Flo Industries, Inc., Bulletin No. ITP-988-CG, "Integra Gas-Fired Energy Source."

2002—A. O. Smith Genesis Service Handbook.

* cited by examiner

WATER HEATER WITH PRESSURIZED COMBUSTION

This application is a continuation of U.S. application Ser. No. 11/034,130, filed Jan. 12, 2005, now U.S. Pat. No. 7,032,543 the entire contents of which are incorporated herein by reference.

BACKGROUND

The present invention relates to a water heater having a pressurized combustion chamber.

SUMMARY

In one embodiment, the invention provides a water heater comprising a water tank adapted to contain water to be heated; a flue extending through the water tank and having an inlet end and an outlet end; a combustion chamber in communication with the inlet end of the flue and having an air intake, the combustion chamber being substantially airtightly sealed except for the inlet end of the flue and the air intake; at least one fan sealed with respect to the air intake such that all air entering the combustion chamber flows through the at least one fan; and a main burner within the combustion chamber and operable to combust a mixture of air and fuel to create hot products of combustion. Operation of the at least one fan raises the pressure in the combustion chamber above atmospheric pressure. The hot products of combustion flow out of the combustion chamber into the inlet end of the flue, heat the water in the tank through the flue, and exit the water heater through the outlet end of the flue.

In some embodiments, the air intake may define an air plenum and a flame arrester may be sealed between the plenum and combustion chamber to contain flames within the combustion chamber. The flue in some embodiments may include a baffle to slow the flow of products of combustion through the flue. The water heater may include a gas valve that is either electric or non-electric, a pressure sensor for sensing pressure in the combustion chamber and/or plenum, a gas pressure switch that activates the at least one fan in response to a change of gas pressure at the gas valve consistent with gas flow to the main burner, a flammable vapor sensor for sensing the presence of flammable vapors in the combustion chamber and/or plenum, and a high-limit water temperature switch for sensing whether the water has exceeded a high limit.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The present invention is intended for use on a flammable vapor ignition resistant (FVIR) water heater of the kind disclosed in U.S. Pat. Nos. 6,109,216; 6,216,643; 6,230,665; and 6,295,952, the entire contents of those patents being incorporated herein by reference. The concept of pressurized combustion may be applied to non-FVIR water heaters as well, provided the water heater includes a combustion chamber that is sufficiently sealed so that it will permit a higher-than-atmospheric pressure condition. The present invention should therefore not necessarily be limited to FVIR water heaters, although the illustrated embodiments include an FVIR application.

Figure 3:
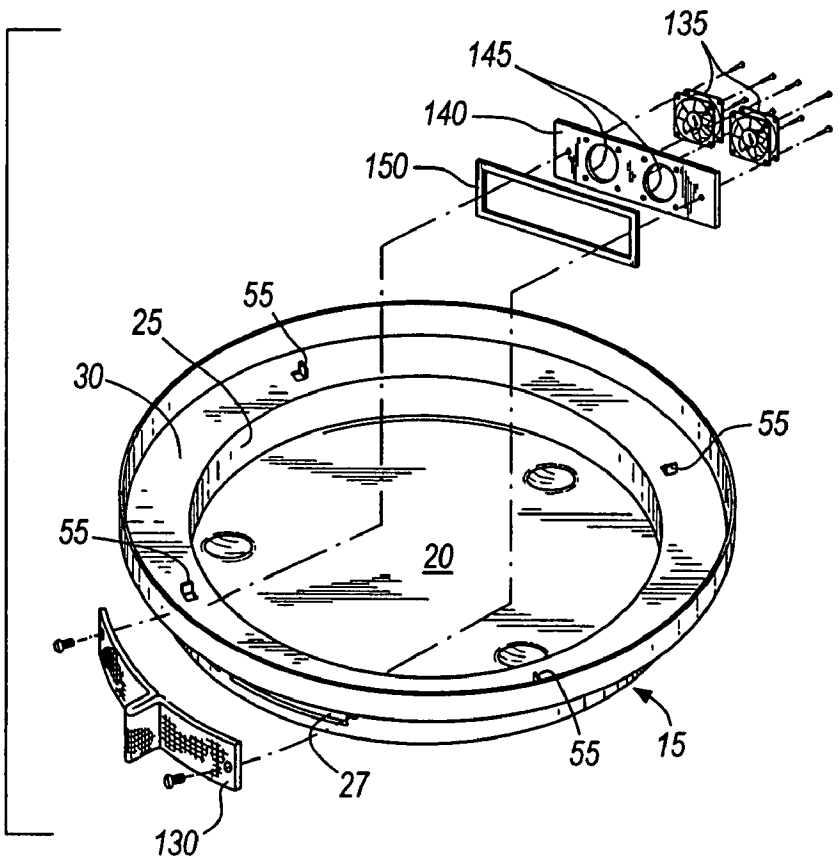
FIG. 3 is an exploded view of the base of the water heater of both illustrated embodiments.
Figure 1:
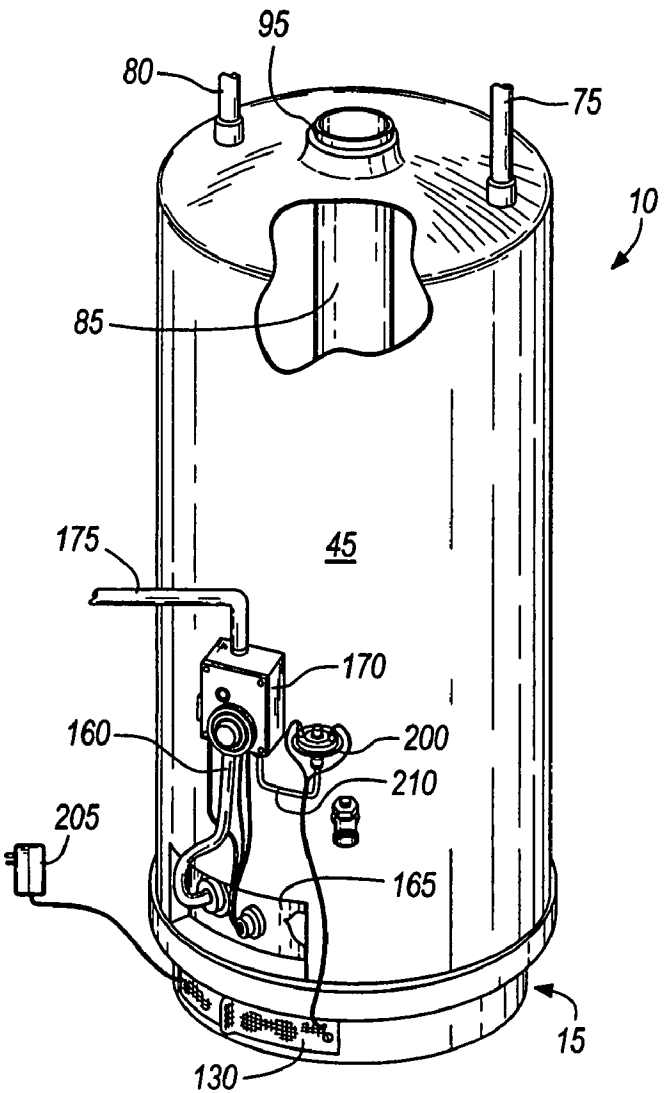
FIG. 1 illustrates water heater according to a first embodiment of the invention.
Figure 2:
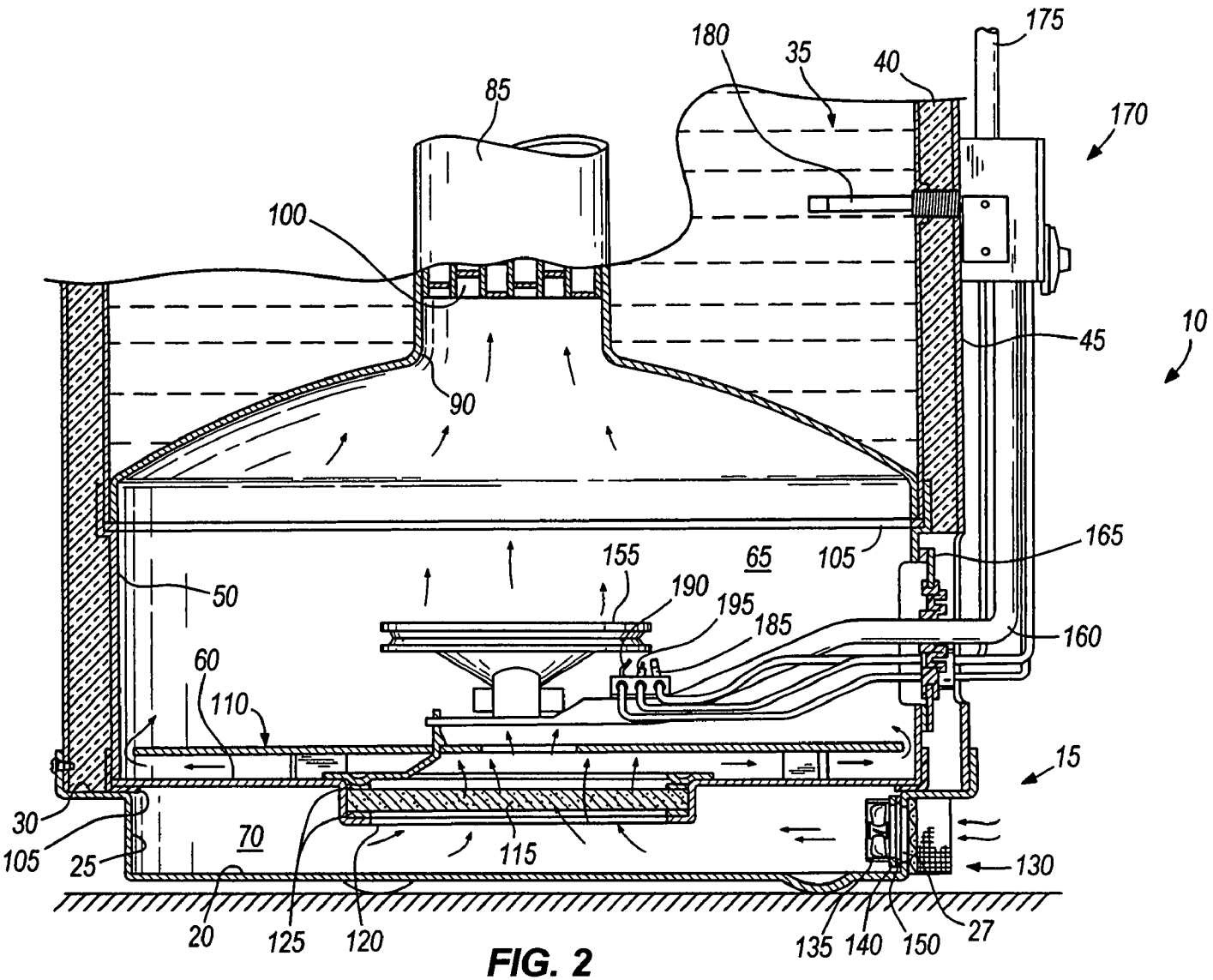
FIG. 2 is a cross section view of the bottom portion of the water heater of FIG. 1.
Figure 4:
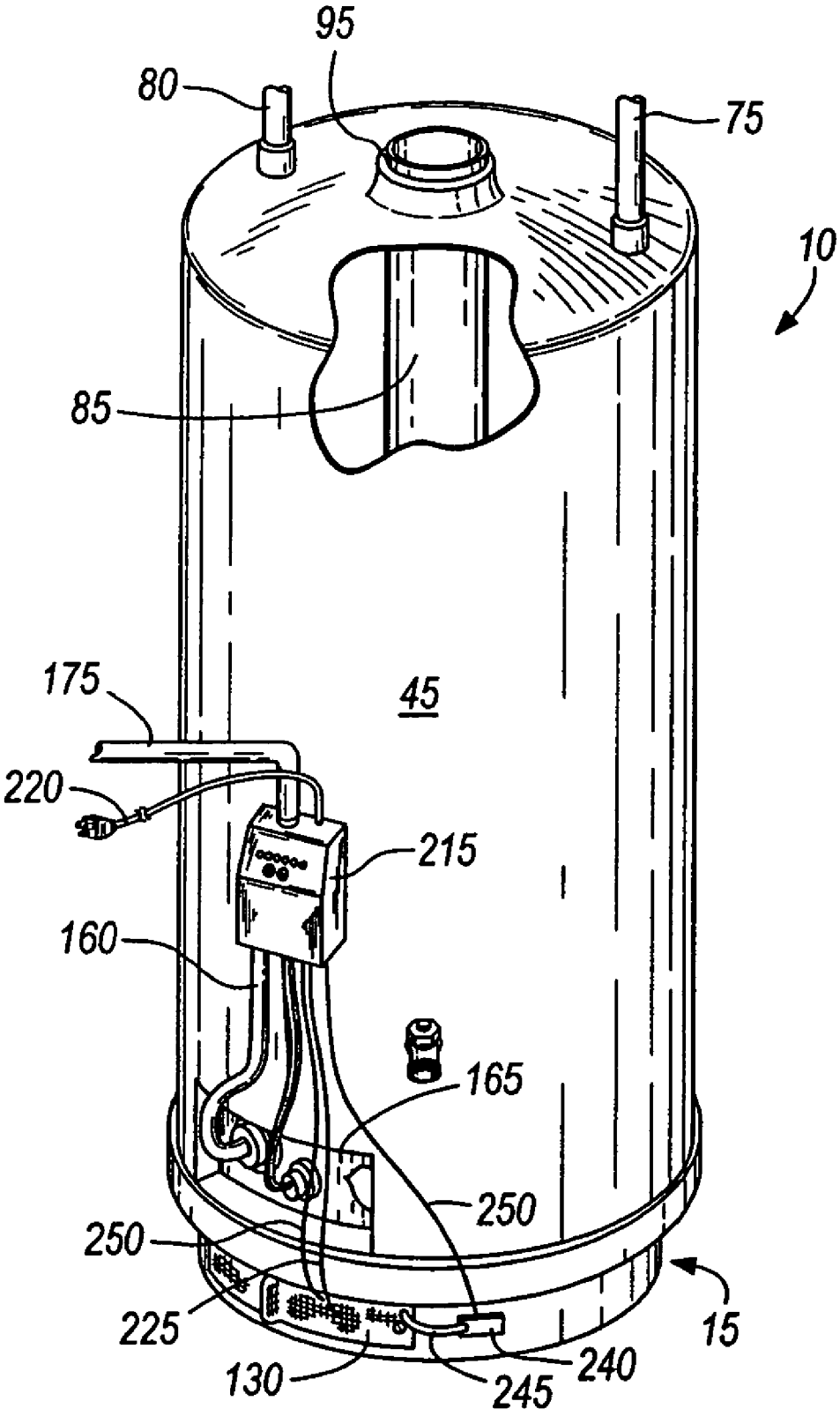
FIG. 4 illustrates a water heater according to a second embodiment of the invention.
Figure 5:
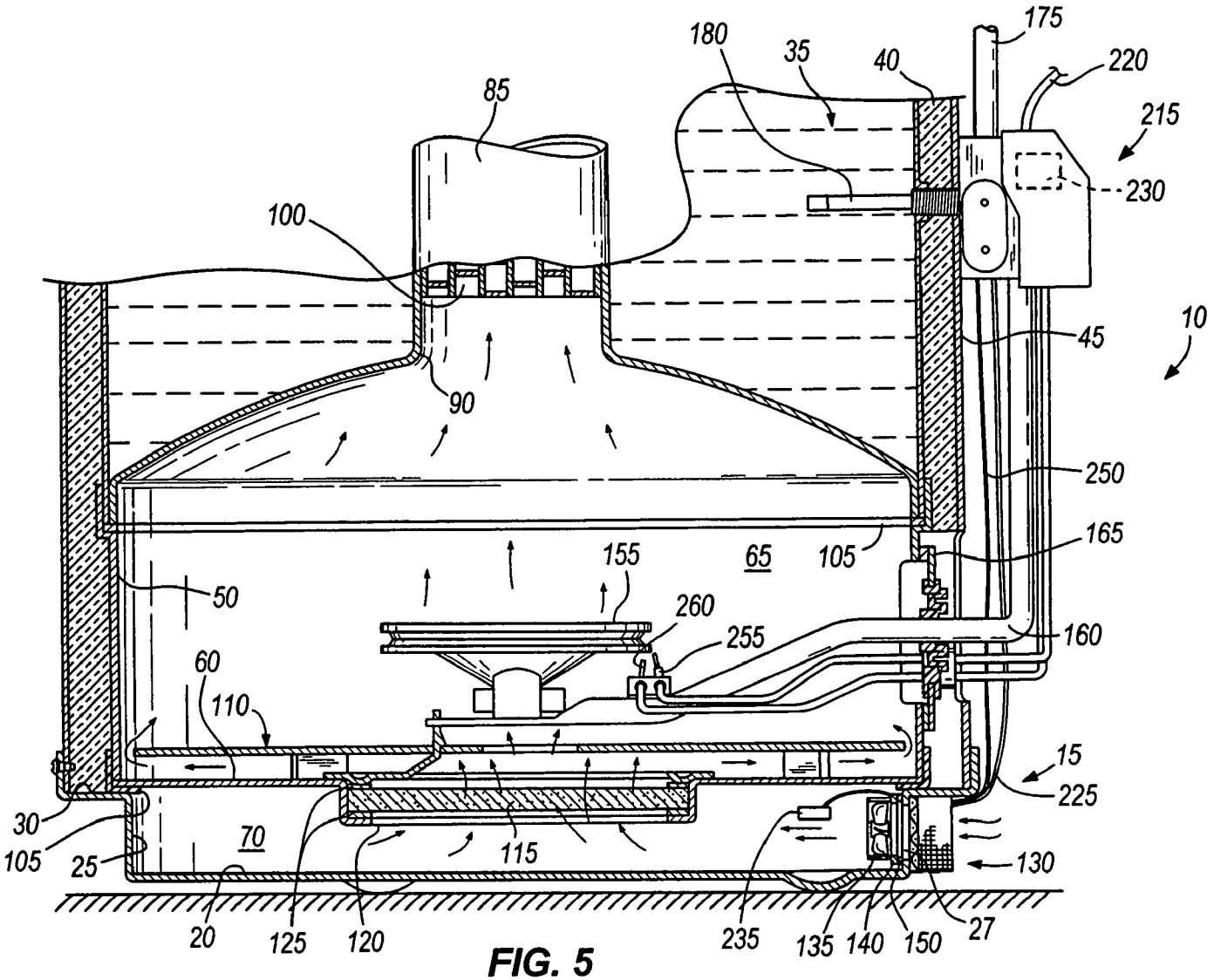
FIG. 5 is a cross section view of the bottom portion of the water heater of FIG. 4.

The present invention is described below in terms of two illustrated embodiments. The first embodiment (FIGS. 1 and 2) includes a water heater having a non-powered gas valve/thermostat, and the second embodiment (FIGS. 4 and 5) includes a water heater having an electric gas valve. The illustrated embodiments have in common many features and the same reference numerals are used in the drawings to indicate identical or similar parts in the two embodiments.

FIGS. 1-5 illustrate a storage-type gas-fired FVIR water heater 10 that includes a base pan 15 that provides the primary structural support for the rest of the water heater 10. The base pan 15 may be constructed of stamped metal or molded plastic, for example, and includes a generally horizontal bottom wall 20, a vertical rise 25 having an air inlet opening 27, and an elevated step 30. The water heater 10 also includes a water tank 35, insulation 40 surrounding the tank 35, and an outer jacket 45 surrounding the insulation 40 and the water tank 35. A skirt 50 is supported by the base pan's elevated step 30 and in turn supports the water tank 35. The elevated step 30 also supports the insulation 40 and jacket 45. Metal tabs 55 are formed (e.g., punched and bent) out of the step 30 material or otherwise provided and affixed on the step 30, and co-axially position the base pan 15 and skirt 50.

Also supported by the elevated step 30 is a divider 60 that divides the space between the bottom of the tank 35, skirt 50, and the base pan 15 into a combustion chamber 65 (above the divider 60) and plenum 70 (below the divider 60).

A cold water inlet tube 75 and a hot water outlet tube 80 extend through a top wall of the water tank 35. A flue 85 extends through the tank 35, and water in the tank 35 surrounds the flue 85. The flue 85 includes an inlet end 90 and an outlet end 95, and has a baffle 100 in it. The baffle 100 slows down the flow of products of combustion through the flue 85, and consequently increases the time during which the products of combustion reside within the flue 85. Generally, heat transfer from the products of combustion to the flue 85 and ultimately to the water increases as the baffle 100 is made more restrictive of fluid flow through the flue 85. The practical restrictiveness of the baffle 100 has its limits, however, due to condensation, combustion quality, and other considerations.

The combustion chamber 65 and plenum 70 space is substantially air-tightly sealed except for the air inlet opening 27 and inlet end 90 of the flue 85, and seals 105 between the skirt 50 and the tank 35 and base pan 15 assist in sealing the space. The seals 105 may be, for example and without limitation, fiberglass material or a high-temperature caulk material. A radiation shield 110 sits on the divider 60 within the sealed combustion chamber 65 and reflects radiant heat up toward the tank 35.

A flame arrester 115 is affixed in a sealed condition across an opening 120 in the divider 60 such that all air flowing from the plenum 70 into the combustion chamber 65 must flow through the flame arrester 115. The air inlet 27, air plenum 70, and opening 120 in the divider 60 together define an air intake for the combustion chamber 65, and all air flowing into the combustion chamber 65 through the opening (see arrows in FIG. 2) 120 must flow through this air intake and the flame arrester 115. It should also be noted that the position and orientation of the flame arrester 115 are not limited to those shown in the drawings, and that substantially any construction will work provided that the flame arrester 115 acts as the gateway for all air flowing into the combustion chamber 65 from the plenum 70. Sealing members 125 seal the periphery of the flame arrester 115 to the divider 60 to reduce the likelihood of air circumventing the flame arrester 115. In alternative constructions, a single sealing member 125 may be used to seal the flame arrester 115 with respect to the divider 60, or if the flame arrester fits snugly against the divider 60, no sealing members 125 may be needed.

The flame arrester 115 prevents flame within the combustion chamber 65 from igniting flammable vapors outside of the combustion chamber 65. To achieve this end, the flame arrester 115 may operate according to one or both of two theories.

The illustrated flame arrester 115 operates according to the first theory of operation, in which the flame arrester is constructed of material characterized by high thermal resistance such that heat on the top surface (i.e., the surface exposed to the combustion chamber) does not spread to the bottom surface (i.e., the surface exposed to the plenum). This prevents the bottom surface from reaching an incandescent temperature that could ignite the flammable vapors near the bottom surface. This type of flame arrester therefore tolerates the presence of flame on its top surface and includes passageways that are sufficiently narrow to prevent flame from propagating through the flame arrester.

This first type of flame arrester may, for example, have through-holes or a random pattern of interconnected voids. A conglomeration of randomly-oriented fibers or particles (e.g., carbon or glass fibers) may be bonded or compressed together to form a cohesive unit including the random pattern of interconnected voids. The size and shape of the particles or fibers are preferably selected to avoid a chain of voids that would allow a flame to travel through the flame arrester and to avoid the isolation of a significant number of voids from other voids, which would effectively increase the density of the flame arrester and unduly restrict the air flow through the flame arrester. The air that is necessary for combustion of the gaseous fuel during normal operation of the water heater is allowed to flow from void to void from the bottom surface to the top surface of the flame arrester. The arduous air-flow path through the flame arrester further (i.e., in addition to the thermal resistance of the material itself) reduces the thermal conductivity of the flame arrester, and substantially ensures that the bottom surface of the flame arrester will be below the ignition temperature of the flammable vapors entering the flame arrester, even when vapors are burning on the top surface of the flame arrester.

In the second theory of operation, the flame arrester quickly extinguishes any flame on its top surface, and does not rely on a high thermal resistivity. In fact, some flame arresters that operate under this principle incorporate materials of high thermal conductivity to quickly diffuse or absorb heat and extinguish the flame. Flame arresters of this type may be constructed of one or more wire mesh screens, for example.

With reference again to FIG. 3, the air inlet 27 is covered by a screen 130 mounted to the outer surface of the base pan 15 and by one or more fans 135 mounted to the inner surface of the base pan 15. In the illustrated embodiment, a plate 140 having holes 145 therein is mounted to the inner surface of the base pan 15 over the air inlet 27, and each fan 135 is mounted to the plate 140 over one of the holes 145. The plate 140 is substantially air-tightly sealed to the base pan 15 by way of a gasket 150 or other means for sealing between the plate 140 and base pan 15, and all air passing through the air inlet 27 flows through the screen 130 and one of the fans 135. The screen 130 filters air flow into the plenum 70 and reduces the likelihood that the flame arrester 115 will become occluded by lint or other debris.

Although two fans 135 are illustrated, the invention may include a single fan or more than two fans depending on the size of the water heater 10, air flow requirements, and other considerations. Also, the fans 135 may in alternative constructions be mounted to the outside of the base pan 15 and may have integral screens in lieu of the illustrated screen 130, or the screen 130 may be mounted inside the base pan 15. The illustrated position of the screen 130 was chosen to permit easy access for cleaning. Also, the fans 135 may be mounted directly to the base pan 15 (i.e., without the plate 140), and with or without a gasket, depending on the quality of the seal between the fans 135 and base pan wall), provided the air inlet 27 is properly shaped so the fans 135 fully cover it.

A main burner 155 in the combustion chamber 65 burns a mixture of gas fuel and air to create the products of combustion that flow up through the flue 85 to heat the water in the tank 35, as discussed above. The main burner 155 receives gas fuel through a gas manifold tube 160 that extends in a sealed condition through an access door 165 mounted in a sealed condition over an access opening in the skirt 50. The two illustrated embodiments differ primarily in the type of ignition system used to ignite the main burner 155, and also in the type of gas valve used to control gas fuel to the main burner 155.

The first embodiment (illustrated in FIGS. 1 and 2), employs a non-powered gas valve/thermostat 170 mounted to the water tank 10. A gas main 175 provides gas fuel to the input side of the non-powered gas valve/thermostat 170. The non-powered gas valve/thermostat 170 includes a water temperature probe 180 threaded into the tank side wall 35. Connected to the output side of the non-powered gas valve/thermostat 170 are the burner manifold tube 160, a pilot burner 185, a thermocouple 190, a spark igniter 195, and a gas pressure switch or relay 200. The pilot burner 185, thermocouple 190, and spark igniter 195 extend into the combustion chamber 65 in a sealed condition through a grommet in the access door 165.

The non-powered gas valve/thermostat 170 provides a flow of gas fuel to the pilot burner 185 to maintain a standing pilot flame, and this construction is therefore generally referred to as a "continuous pilot ignition" system. The spark igniter 195 is used to initiate flame on the pilot burner 185 without having to reach into the combustion chamber with a match. A spark is generated by the spark igniter 195 in response to pushing a button on the non-powered gas valve/thermostat 170. The thermocouple 190 provides feedback to the non-powered gas valve/thermostat 170 as to the presence of flame at the pilot burner 185. More specifically, the non-powered gas valve/thermostat 170 includes an interrupter valve or some other means for selectively shutting off fuel flow to the pilot burner 185 and main burner 155. The interrupter valve is biased toward a closed position. The interrupter valve is held open by a voltage arising in the thermocouple 190 in response to the tip of the thermocouple 190 being heated by the pilot burner flame. If the pilot burner 185 loses its flame, the thermocouple 190 will cool down and not provide the voltage to the interrupter valve, and the interrupter valve will close and shut off fuel flow to the pilot burner 185 and main burner 155.

The non-powered gas valve/thermostat 170 permits gas fuel to flow to the main burner 155 in response to a water temperature sensor (e.g., the water temperature probe 180) indicating that the water temperature in the water tank 35 has fallen below a selected temperature. When gas fuel flows to the main burner 155, it is mixed with air and the mixture is ignited when it contacts the pilot burner flame. Once the water temperature sensor indicates that the water has reached the desired temperature, the non-powered gas valve/thermostat 170 shuts off gas fuel flow to the main burner 155, and the water heater 10 is in "standby mode" until the water temperature again drops to the point where the non-powered gas valve/thermostat 170 must again provide gas fuel to the main burner 155.

A transformer/converter 205 plugs into a standard outlet providing 110-volt alternating current (A/C) electricity. The transformer/converter 205 steps the voltage down and converts it to 12 or 24 volt direct current (D/C) electricity, which is delivered to the electric fans 135. The fans 135 are preferably standard 12 volt or 24 volt D/C electric fans. The fans 135 preferably have permanent magnet D/C motors to avoid sparks or discharges that may ignite flammable vapors.

The pressure switch 200 is part of the electrical circuit providing electricity to the fans 135 and is connected in series between the transformer/converter 205 and the fans 135. The pressure switch 200 includes a tube 210 that references the pressure switch 200 to the gas pressure at the manifold tube 160 connection. The pressure switch 200 senses an increase in pressure when gas fuel is permitted to flow to the main burner 155, and closes the electrical circuit in response to the pressure increase to permit electricity to flow to the fans 135 to thereby energize or activate the fans 135. The gas pressure switch 200 opens the electrical circuit when the pressure at the main burner manifold 160 drops in response to gas fuel flow to the main burner 155 being shut off. The fans 135 in this embodiment therefore run during main burner operation.

When operating, the fans 135 raise the pressure within the plenum 70 and combustion chamber 65. Fuel and primary air are mixed upstream of the burner 155 within the combustion chamber 65 (there is no fuel mixing within the plenum 70) and is combusted at the burner 155. Secondary air within the combustion chamber 65 combines with the primary air and fuel mixture to complete the combustion process at the outlet of the burner 155. In this regard, the fans 135 pressurize both primary and secondary air. The higher-than-atmospheric pressure within the plenum 70 aids in the flame arrester's functionality because it reduces the likelihood of vapors and fuel flowing out of the combustion chamber 65 into the plenum 70 (i.e., it biases the flow of gases out of the plenum 70 into the combustion chamber 65 and further into the flue 85).

The second illustrated embodiment (FIGS. 4 and 5) includes an electric gas valve 215 that includes a power cord 220 to be plugged into a standard 110-volt wall socket. The electric gas valve 215 preferably runs on 12 or 24 volt D/C power, and includes an internal transformer and rectifier that step the voltage down to 12 or 24 volts and convert the current to D/C. The electric gas valve 215 provides power to the fans 135 through a power cord 225. Because of the relatively small size (as compared to, for example, a power vent blower) of the fans 135, the fans 135 can be run off the same power source as the gas valve 215. The illustrated fans 135, for example, have power inputs of less than about 10 Watts. The electric gas valve 215 includes a controller or CPU 230.

The second embodiment also includes a flammable vapor sensor 235 (FIG. 5) mounted in the plenum 70, and a pressure sensor 240 and pressure sensing tube 245 (FIG. 4) mounted outside the base pan 15. The sensors 235, 240 communicate with the electric gas valve 215 through sensor conduits 250. The flammable vapor sensor 235 could alternatively be mounted in the combustion chamber 65, but then the sensor 235 would need to withstand the temperature conditions in the combustion chamber 65. The second illustrated embodiment employs an intermittent ignition system, which includes a hot surface igniter 255 and a flame sensor 260 in place of the pilot burner 185, thermocouple 190, and spark igniter 195 of the first embodiment.

Control logic in the controller 230 initiates operation of the fans 135 and checks the conditions in the plenum 70 prior to energizing the igniter 255 and permitting fuel flow to the main burner 155. More specifically, if the flammable vapor sensor 235 indicates that flammable vapors are present in the plenum 70 or combustion chamber 65 (depending on where the sensor 235 is mounted), the controller 230 activates the fans 135 and gives them enough time to purge such vapors through the plenum 70, combustion chamber 65, and flue 85, and confirms through the sensor 235 that the vapors have in fact been purged, prior to energizing the igniter 255 and permitting fuel flow to the main burner 155. The controller 230 may be programmed with a set point for acceptable levels or concentrations of flammable vapors prior to initiating burner ignition. For example, the controller 230 may be set to only permit main burner 115 ignition after the flammable vapor sensor 235 indicates zero flammable vapors in the plenum 70, or the controller 230 may be set to permit main burner 115 ignition when flammable vapors are still present in the plenum 70, but at concentrations less than the lower explosive limit of the flammable vapor. The controller 230 includes a timer function to de-energize the fans 135 in the event flammable vapors do not purge after extended fan operation (e.g., if there is a saturated flammable vapor environment around the water heater 10 that the fans 135 cannot clear and that requires other intervention).

Also, after energizing the fans 135 and prior to energizing the igniter 255 and permitting fuel flow to the burner 155, the controller 230 monitors the pressure sensor 240. The pressure sensor 240 compares ambient pressure to pressure in the tube 245 (communicating with the plenum 70 or combustion chamber 65) to determine whether there is an increase in pressure in the plenum 70 or combustion chamber 65 in response to fan operation. If pressure does not sufficiently increase, the controller 230 concludes that there is a leak in the plenum 70 or combustion chamber 65, a fan malfunction, or a blockage of the airflow into the plenum 70 or combustion chamber 65, and will not energize the igniter 255 or permit fuel flow to the burner 155.

Once the controller 230 is satisfied that there are no flammable vapors in the plenum 70 and that the combustion chamber 65 is sufficiently pressurized (as evidenced by the pressure rise in response to fan operation), the controller 230 energizes the hot surface igniter 255, waits for a period of time sufficient for the hot surface igniter 255 to reach a temperature sufficient to ignite a combustible mixture of fuel and air, and then permits fuel flow into the burner 155 where it is mixed with air and the mixture flows out of the burner 155. The air/fuel mixture ignites upon contact with the hot surface igniter 255.

The controller 230 then uses flame rectification principles and methods to determine with the flame sensor 260 whether flame is present at the burner 155. More specifically, the controller 230 applies alternating voltage to the flame sensor 260 and uses the flame (if present) as the ground for the circuit. The controller 230 continues to provide gas fuel to the burner 155 while a D/C offset current is measured between the flame sensor 260 and the flame, and shuts down gas flow to the burner 155 in the absence of current flow. If flame is not present at the main burner 155, the controller 230 may be programmed to purge the combustion chamber 65 of gas fuel by energizing the fans 135, and then try again to ignite the main burner 155.

In both illustrated embodiments, the water heater's efficiency is increased due to the combined use of the pressurization fans 135 and the baffle 100, which in tandem increase the heat transfer to the flue 85. In atmospheric water heaters, the restrictiveness of a flue baffle 100 is limited by the force of the natural convection currents in the flue 85 caused by the buoyancy of the hot products of combustion. In the present invention, however, the positive pressure created by the fans 135 forces the products of combustion up through the flue 85, and a more restrictive baffle 100 can be used.

It should be noted that, while the first and second embodiments include a non-powered gas valve and an electric gas valve, respectively, it is possible to use a hybrid system that uses an electric valve in combination with continuous pilot ignition. Such hybrid system may include an electric gas valve that includes a voltage sensor that tells the controller the magnitude of the voltage in the thermocouple. The controller would therefore be able to monitor the strength of the pilot flame and determine when a low-oxygen condition is arising in the combustion chamber. In such a situation, the controller may activate the fans to add oxygen-rich ambient air to the combustion chamber and purge the low-oxygen air from the combustion chamber. If the low-oxygen condition is due to a cause that is not overcome by activation of the fans, the controller would diagnose such conditions when activation of the fan does not help strengthen the pilot flame, and the controller may shut down fuel flow to the pilot and main burners. Use of an electric gas valve having a controller with a continuous pilot ignition system would also enable the use of flammable vapor and/or pressure sensors as discussed above with respect to the second embodiment.

Another way for such hybrid system to determine when a low-oxygen condition arises is to monitor water temperature. When the water temperature is hot, the flue and any gases within the flue remain warm, and convection currents caused by the pilot burner alone will be able to flow up through the flue (even with the restrictive baffle in place). If, however, the water in the tank becomes cold, but not so cold as to trigger operation of the main burner (e.g., when the set point of the water heater is low, as when in a vacation or temperature set-back mode), the flue may become cool enough to retard convection currents caused by the pilot burner alone. Under such circumstances, the hot products of combustion created by the pilot burner alone will be insufficient to support convection currents of sufficient strength to flow up through the cold flue (especially with the restrictive baffle in place). Thus, the controller may be programmed to activate the fans when the temperature probe senses a cold water condition in which it is likely that the pilot burner products of combustion are not able to flow through the flue on their own. Activation of the fans will force the products of combustion of the pilot flame out of the combustion chamber and replenish fresh air into the combustion chamber.

A hybrid system with a continuous pilot ignition and electric gas valve would also be able to energize the fans in response to sensing the water temperature exceeding a high limit. A high water temperature situation may occur with a continuous pilot ignition system during long periods of standby. During standby, the baffle may retain products of combustion generated by the pilot flame in the flue 85 long enough to heat the water in the tank beyond the water heater's set point. If such a high water temperature situation occurs, the controller in the electric gas valve may be programmed to activate the fans without permitting fuel flow to the main burner. The resulting influx of relatively cool ambient air into the combustion chamber and flue strips heat from the water in the tank and reduces the water temperature. When the water temperature is again safely below the high temperature set point, the controller would be programmed to deactivate the fans.

The invention claimed is:

1. A water heater comprising:

a water tank adapted to contain water to be heated;

a flue extending through the water tank and having an inlet end and an outlet end;

a combustion chamber in communication with the inlet end of the flue, the combustion chamber having an air intake defining an air inlet, said combustion chamber being substantially air-tightly sealed except for the air inlet and the inlet end of the flue;

means for introducing air into the combustion chamber and raising the pressure of both primary and secondary air in the combustion chamber above atmospheric pressure; and a main burner within the combustion chamber and operable to combust a mixture of air and fuel to create products of combustion;

wherein the products of combustion flow out of the combustion chamber into the inlet end of the flue, heat the water in the tank through the flue, and exit the water heater through the outlet end of the flue; wherein primary air is mixed with fuel prior to combustion at the main burner; wherein secondary air within the combustion chamber combines with the primary air and fuel mixture to complete the combustion process at an outlet of the burner.

2. The water heater of claim 1, further comprising a flammable vapor sensor; and a controller that initiates ignition of the main burner only after the flammable vapor sensor senses an acceptable concentration of flammable vapors.

3. The water heater of claim 1, further comprising a flammable vapor sensor; and a controller that shuts down operation of the main burner in response to the flammable vapor sensor sensing an unacceptable concentration of flammable vapors.

4. The water heater of claim 1, further comprising a pressure sensor that senses pressure in the combustion chamber; and a controller that initiates ignition of the main burner only after the pressure sensor senses a rise in pressure in the combustion chamber.

5. The water heater of claim 1, further comprising an electrically-powered fuel valve, the valve and the means for introducing air into the combustion chamber being powered with electricity from a single source.

6. The water heater of claim 1, further comprising a baffle in the flue operable to slow the rate at which products of combustion flow through the flue to thereby increase heat transfer through the flue wall to the water in the tank.

7. The water heater of claim 1, wherein the air intake includes an air plenum between the air inlet and the combustion chamber, the water heater further comprising a flame arrester sealed between the plenum and combustion chamber such that substantially all air flowing into the combustion chamber from the plenum flows through the flame arrester, the flame arrester permitting ingress of flammable vapors into the combustion chamber but substantially preventing egress of flame out of the combustion chamber into the plenum.

8. A water heater comprising:

a water tank adapted to contain water to be heated;

a flue extending through the water tank and having an inlet end and an outlet end;

a combustion chamber in communication with the inlet end of the flue, the combustion chamber having an air intake defining an air inlet, said combustion chamber being substantially air-tightly sealed except for the air inlet and the inlet end of the flue;

means for introducing air into the combustion chamber and raising the pressure of air in the combustion chamber above atmospheric pressure;

a main burner within the combustion chamber and operable to combust a mixture of air and fuel to create products of combustion, wherein the products of combustion flow out of the combustion chamber into the inlet end of the flue, heat the water in the tank through the flue, and exit the water heater through the outlet end of the flue;

a baffle in the flue operable to slow the rate at which products of combustion flow through the flue to thereby increase heat transfer through the flue wall to the water in the tank; and wherein the air intake includes an air plenum between the air inlet and the combustion chamber, the water heater further comprising a flame arrester sealed between the plenum and combustion chamber such that substantially all air flowing into the combustion chamber from the plenum flows through the flame arrester, the flame arrester permitting ingress of flammable vapors into the combustion chamber but substantially preventing egress of flame out of the combustion chamber into the plenum.

9. The water heater of claim 8, further comprising a flammable vapor sensor; and a controller that initiates ignition of the main burner only after the flammable vapor sensor senses an acceptable concentration of flammable vapors.

10. The water heater of claim 8, further comprising a flammable vapor sensor; and a controller that shuts down operation of the main burner in response to the flammable vapor sensor sensing an unacceptable concentration of flammable vapors.

11. The water heater of claim 8, further comprising a pressure sensor that senses pressure in the combustion chamber; and a controller that initiates ignition of the main burner only after the pressure sensor senses a rise in pressure in the combustion chamber.

12. The water heater of claim 8, further comprising an electrically-powered fuel valve, the valve and the means for introducing air into the combustion chamber being powered with electricity from a single source.

13. A water heater comprising:

a water tank adapted to contain water to be heated;

a flue extending through the water tank and having an inlet end and an outlet end;

a combustion chamber in communication with the inlet end of the flue, the combustion chamber having an air intake defining an air inlet, said combustion chamber being substantially air-tightly sealed except for the air inlet and the inlet end of the flue;

at least one fan sealed with respect to the air inlet such that the combustion chamber is downstream of the at least one fan and air flows through the fan to the combustion chamber, wherein operation of the at least one fan raises the pressure in the combustion chamber above atmospheric pressure; and a main burner within the combustion chamber and operable to combust a mixture of air and fuel to create products of combustion;

wherein the products of combustion flow out of the combustion chamber into the inlet end of the flue, heat the water in the tank through the flue, and exit the water heater through the outlet end of the flue; wherein primary air is mixed with fuel prior to combustion at the main burner; wherein secondary air within the combustion chamber combines with the primary air and fuel mixture to complete the combustion process at an outlet of the burner; and wherein the at least one fan pressurizes both primary and secondary air in the combustion chamber.

* * * * *